US005249397A

United States Patent [19]

Monaco

[11] Patent Number: 5,249,397

[45] Date of Patent: Oct. 5, 1993

[54] KNOCKDOWN ROOF PLATFORM FOR USE ON AN INCLINED ROOF

[76] Inventor: Gary J. Monaco, 4 Winding Branch Rd., Hawthorn Woods, Ill. 60047

[21] Appl. No.: 821,967

[22] Filed: Jan. 16, 1992

[51] Int. Cl.[5] ..... E04D 15/07

[52] U.S. Cl. ..... 52/126.1; 52/749; 182/45; 248/148

[58] Field of Search ..... 182/45; 248/148, 237; 108/64

[56] References Cited

U.S. PATENT DOCUMENTS

| | | | |
|---|---|---|---|
| 298,463 | 5/1884 | Guedle | 182/45 |
| 590,872 | 9/1897 | Allen | 182/45 |
| 590,949 | 9/1897 | Wilken | 248/148 |
| 1,026,097 | 5/1912 | Lewis | 182/45 |
| 1,028,362 | 6/1912 | King | 182/45 |
| 1,306,434 | 6/1919 | Melanson | 248/237 |
| 1,423,726 | 7/1922 | Mohr et al. | 182/45 |
| 2,253,772 | 8/1941 | Edgren | 108/62 |
| 2,517,681 | 8/1950 | Koerper | 108/64 |
| 2,662,680 | 12/1953 | Bronson | 248/148 |
| 2,851,311 | 9/1958 | Gibbs | 108/64 |
| 2,936,849 | 5/1960 | Larson | 182/111 |
| 3,236,003 | 2/1966 | Flood | 108/64 |
| 4,962,906 | 10/1990 | Fatool | 248/148 |

*Primary Examiner*—James L. Ridgill, Jr.

[57] ABSTRACT

A knockdown roof platform for use on an inclined roof comprising a table structure an upper flat table top. The table structure has a hollowed area on its underside. Struts are formed integral inside the hollowed area on an underside of the upper flat table top. An upright leg structure is positioned at one end of the table structure having an upper flat table surface positioned in a common plane with the upper flat table top. A hinge connects the table structure and the upright leg structure in assembly together. Collapsible locking brackets further secure the table structure and the upright leg structure in assembly. The collapsible locking brackets are being adjustable to secure the table structure and the upright leg structure in right angular relation thereby positioning the upper flat table top co-planar with the upper flat table top on the table structure. The collapsible locking bracket is releasable enabling the table structure and the upright leg structure to be pivoted on the hinge thus moving and collapsing the table structure and the upright leg structure out of right angular relation relative to one another and into a storage position where the table structure and the upright leg structure extend almost in parallel relation.

7 Claims, 2 Drawing Sheets

KNOCKDOWN ROOF PLATFORM FOR USE ON AN INCLINED ROOF

BACKGROUND OF THE INVENTION

1. Field of the Invention

My invention is particularly related to a new and improved lightweight type of a reinforced knockdown roof platform for use on an inclined roof so that a worker can carryout anyone of a number of work assignments on a building roof such as repairing of roof shingles. The platform is mounted on an inclined roof and act to support painting or roofing materials and the like.

One of the more pertinent patents found in the ones noted above is the U.S. Pat. No. 1,026,097 which shows one type of a collapsible shingling stool. The stool found in this patent is not believed to be of a lightweight construction nor as sturdy or as reliable as my reinforced platform since it does not possess the improved structural features found in my platform.

More particularly my platform is lightweight, collapsible and readily adjustable to be sized for roofs having different pitches. To this end, the platform has an upright leg structure with adjustable tubular legs uniquely fitted into and adjustably secured with the upright leg structure. A handle is provided on the upright leg structure to permit the collapsible platform to be readily transported when collapsed.

SUMMARY OF THE INVENTION

A knockdown roof platform for use on an inclined roof comprising a table structure an upper flat table top. The table structure has a hollowed area on its underside. Struts are formed integral inside the hollowed area on an underside of the upper flat table top. An upright leg structure is positioned at one end of the table structure having an upper flat table surface positioned in a common plane with the upper flat table top. A hinge means connects the table structure and the upright leg structure in assembly together. Collapsible locking bracket means further secure the table structure and the upright leg structure in assembly. The collapsible locking bracket means is adjustable to secure the table structure and the upright leg structure in right angular relation thereby positioning the upper flat table top co-planar with the upper flat table top on the table structure. The collapsible locking bracket is releasable enabling the table structure and the upright leg structure to be pivoted on the hinge means thus moving and collapsing the table structure and the upright leg structure out of right angular relation relative to one another and into a storage position where the table structure and the upright leg structure extend almost in parallel relation.

According to other features of my invention, the upright leg structure is essentially U-shaped. Opposite legs of the U-shape is comprised of a pair of spaced apart hollow open ended parallel-sided tubular supports. Parallel-sided adjustably positionable tubular legs are insertable into the spaced apart hollow open ended parallel-sided tubular supports. Attachment means joining the tubular supports with the tubular legs in telescoped adjusted assembly, the attachment means comprising alignable holes, the tubular legs and supports, the attachment means further comprising removable and attachable pin insertable in the holes are provided for joining the adjustably positionable legs in a selected assembled position with the opposite legs thereby fixing the upper flat table top in a roof supported horizontal plane.

According to other features of my invention, the upright leg structure is advantageously positioned relative to the end of the table structure so that the material used to comprise the leg structure can be utilized not only to support the upper flat table top but it also can be used to expand and enlarge the overall area of the work surface of the table structure. Furthermore, none of the prior art is believed to possess sufficient traction to enable effective use on a wide variety of roofing surfaces, without slipping or movement. The present invention satisfies this need.

Yet other features of my invention concern the provision of feet provision means which secure the rubber feet with lower ends of said adjustably positionable legs in assembly together.

Yet other objects and features of my invention will be become apparent in view of the following detailed description of my invention taken in conjunction with the accompanying drawings illustrating a single embodiment also as hereafter described.

DESCRIPTION OF THE PREFERRED EMBODIMENT

Figure 1:
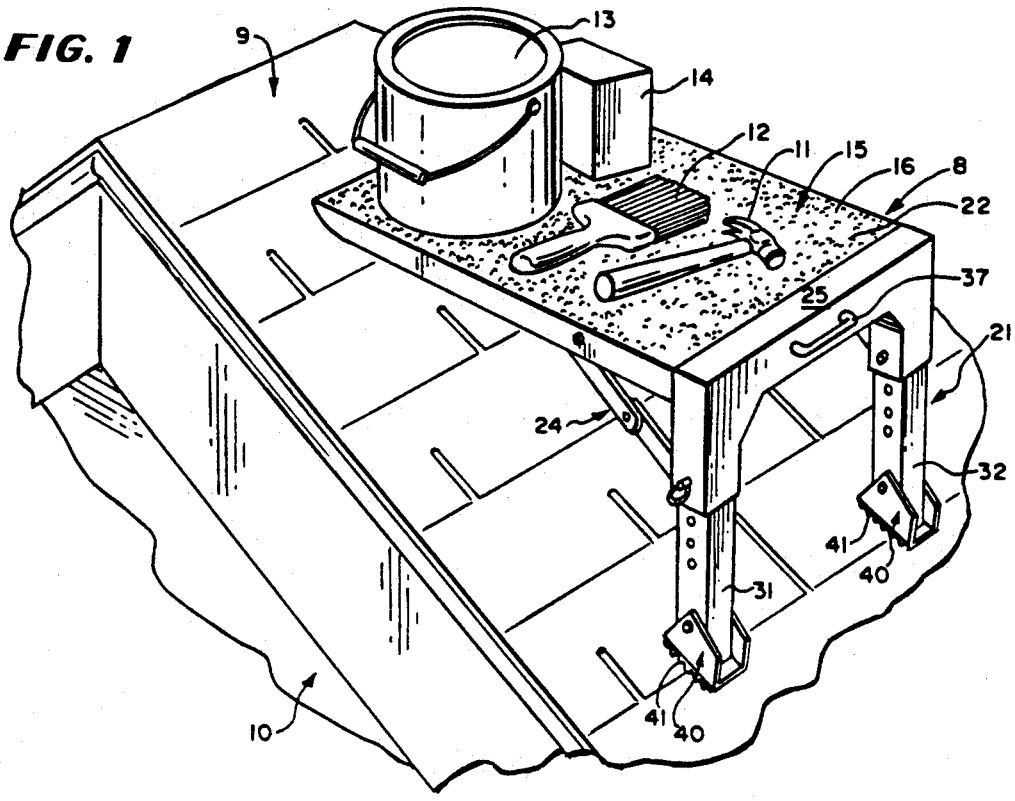
FIG. 1 is an enlarged perspective view of my knockdown roof platform shown on an inclined roof of a building with tools supported thereon.
Figure 2:
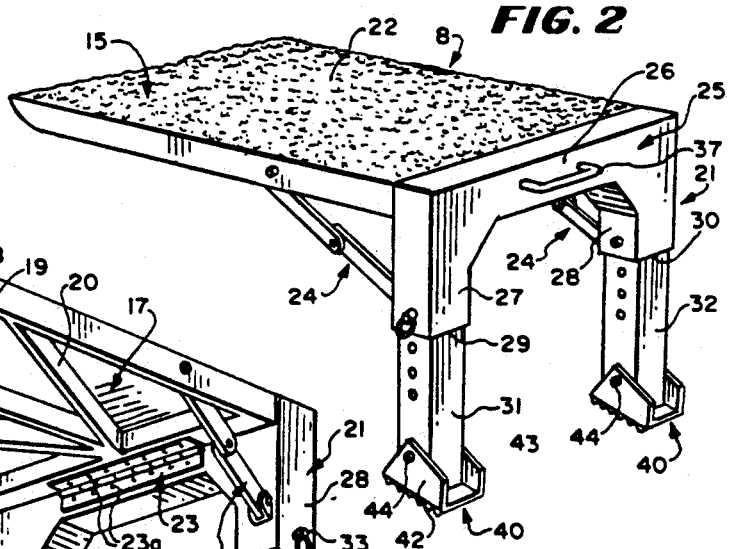
FIG. 2 is an enlarged perspective view of the platform shown in FIG. 1 standing free of the roof.

The reference number 8 indicates generally my new and improved knockdown roof platform. The platform 8 is adapted for mounted disposition upon an inclined roof 9 of a building 10 as depicted in FIG. 1. The platform is particularly adapted to enable a roofer or worker to perform a number of work assignments on the roof, such as to fix shingles or to shingle the roof or to paint the board on a building beneath the roof 11 and alike.

It will be seen in FIG. 1 that various types of tools are shown on the platform 8 including a hammer 11, a paint brush 12, a paint can 13, and a box of roofing nails 14. All of these tools are mounted on a table structure 15, and more particularly on an upper flat table top 16. The table top 16 is preferably comprised of a single piece of cast aluminum or other suitable lightweight aluminum alloy type material. The table structure 15 has a hollowed area 17 on its underside. Aluminum Struts 18, 19 and 20 formed from a suitable material such as aluminum are formed integral inside the hollow area 17 on an underside of the flat table top 16 as shown in FIG. 3.

The materials used to form my knockdown roof may be modified or varied to allow the platform to support a person or other heavy objects.

An aluminum leg structure 21 is provided at one end of the upper flat table top 16 to assist in supporting the table top 16 in a horizontal plane on the inclined roof 9. The flat table top 16 has an upper flat table surface 22 which carries the previously described tools 12, 13 and the nails 14.

Figure 3:
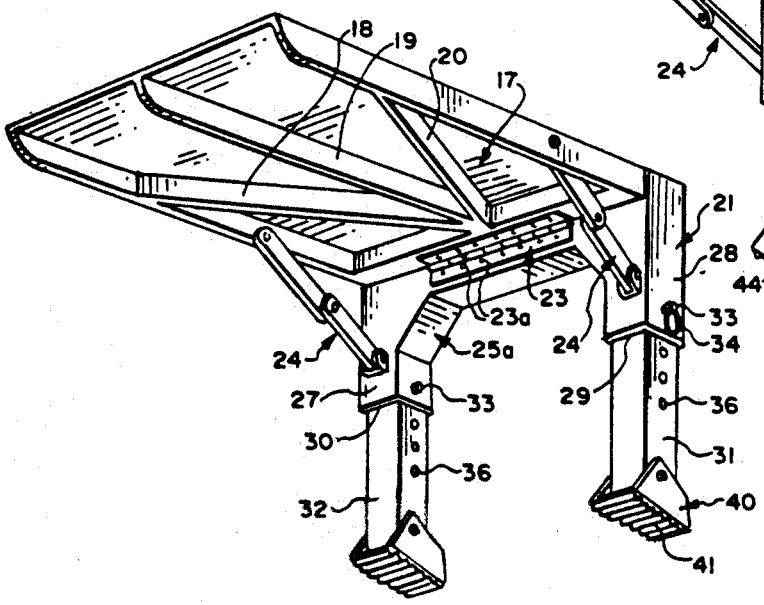
FIG. 3 is another enlarged perspective view of my knockdown roof platform shown in FIG. 2 as viewed from an underside position.

A hinge device 23 which may be a piano type hinge is secured by suitable fasteners such as screws 23*a* to the underside of the flat table top 16 and to an inner wall of the upright leg structure as seen in FIG. 3. Also provided for securing the table top 16 and the upright leg structure 21 are a pair of collapsible leg locking brackets 24,24 for locking the legs in an upright position relative to the table structure 15 as seen in FIGS. 1–4.

The leg structure 21 includes a U-shaped hollow upper leg structure 25 which can be formed from molded plastic or a suitable aluminum. It is believed that the leg structure can be most economically formed from a suitable molded synthetic plastic. This leg structure 25 has a bridging hollow leg section 26 and a pair of downwardly extending hollow leg sections 27 and 28 joined at opposite ends of the bridging leg section 26. Each of the hollow leg sections 27 and 28 possesses a parallel sided square-shaped leg opening and these leg openings are indicated at 29 and 30 respectively.

The leg structure 21 further includes a pair of parallel upright telescopingly mounted lower leg sections 31 and 32 which are also of a square-shaped external peripheral conformation of slightly smaller size than the leg openings 29 and 30 so that the lower leg sections can telescope through the leg openings 29 and 30 as seen in the patent drawings attached herewith.

The aluminum leg structure 21 further includes hollow lower leg sections 31 and 32. In order to secure the lower leg sections 31 and 32 with the hollow upper leg structure 25, My preferred embodiment uses attachment pins 33. The pins 33 each have a ring 34 secured thereto. It should be understood that alternative fasteners can be used to secure the lower leg sections in any one of a variety of preselected positions without departing from my invention.

Pin holes 35 are provided in the downwardly extending hollow leg sections 27 and 28 on opposite sides of each leg section since they are arranged in pairs to permit the attachment pins 33 to extend through a matched pair of the pin holes 35 on opposite sides of the associated leg section. In addition, the hollow lower leg sections are provided with pin holes 36. Each of the pins 33, when secured in place with the downwardly extending hollow leg sections 27 and 28 and the hollow lower section 31 and 32 extend through four pin holes to form a connection.

The U-shaped hollow upper leg structure 25 is further provided with a carrying handle 37 which is formed integral with the bridging hollow leg section 26 and extends at right angles away from the bridging hollow leg section 26. This handle can be used to carry the collapsible platform in the manner illustrated in FIG. 6.

Figure 4:
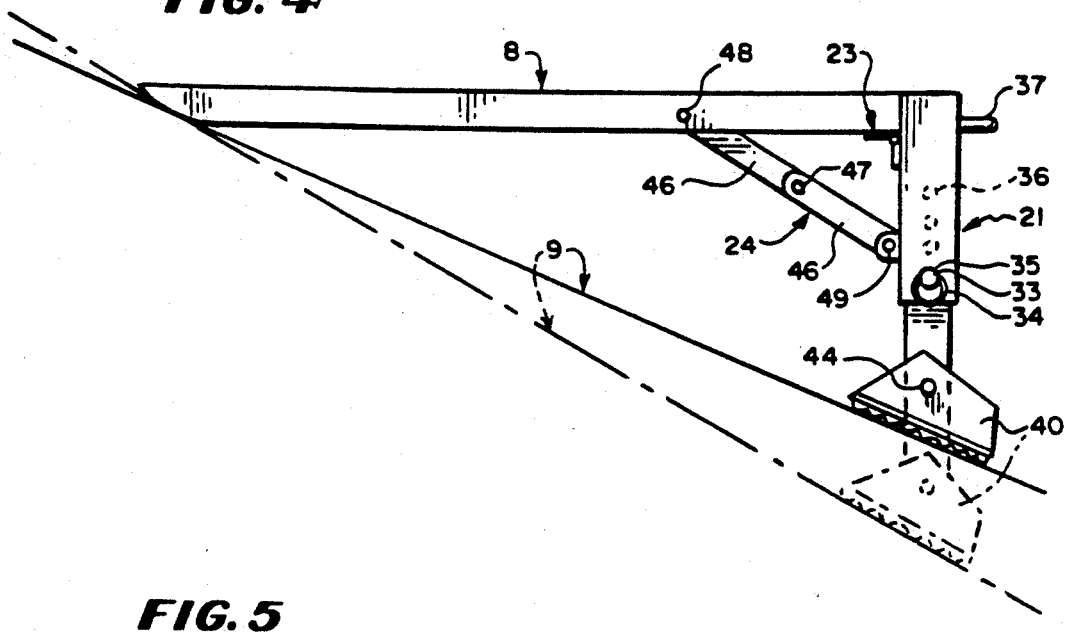
FIG. 4 is a side view of my knockdown roof platform shown in full and dotted lines with relation to an inclined roof illustrating how the feet on the platform can be adjusted to correspond to an angle of inclination of the roof.

The platform 8 also includes identical feet 40,40 which are of a sheet metal construction and can be made from aluminum, steel, or other materials as desired. The feet 40,40 are provided with rubber pads 41,41 or other surface materials or design to provide traction which are glued or otherwise attached to or made a part of an underside of the feet 40,40 in integral assembly therewith. Each of the feet 40,40 has a pair of upright foot flanges 42,43 which are spaced apart and adapted to engage on opposite sides of the lower leg sections 31 and 32. Attachment pins 44 extend through the upright foot flanges 42,43 as well as through the associated lower leg sections which sections are indicated at 31 and 32. Thus, the attachment pins 44 can either be in the form of rivets or can be secured by other suitable means, as desired. It is necessary, however, that the feet 40,40 be readily movable and adjustable with respect to the lower leg sections 31 and 32 so that the feet can be positioned at different angles of inclination depending on the pitch of the roof where the platform is to be mounted all as shown in FIG. 1 and as further shown by the dotted lines in FIG. 4. In FIG. 4, the adjustability of the lower leg sections 31 and 32 is also illustrated. Here the position of the lower legs is preferably adjustable for the purpose of maintaining the upper flat table surface 22 in a horizontal plane so that different types of tools can be readily supported on the platform as shown in FIG. 1.

According to other features of my invention, the table structure 15 is positioned at right angles with regard to the aluminum leg structure 21 in abutting relation there against. A top surface 45 of the U-shaped hollow upper leg structure 25 is positioned co-planar with the top table surface 22 to enlarge the overall size of the table area for supporting various types of tools thereon as shown in FIG. 1.

Figure 5:
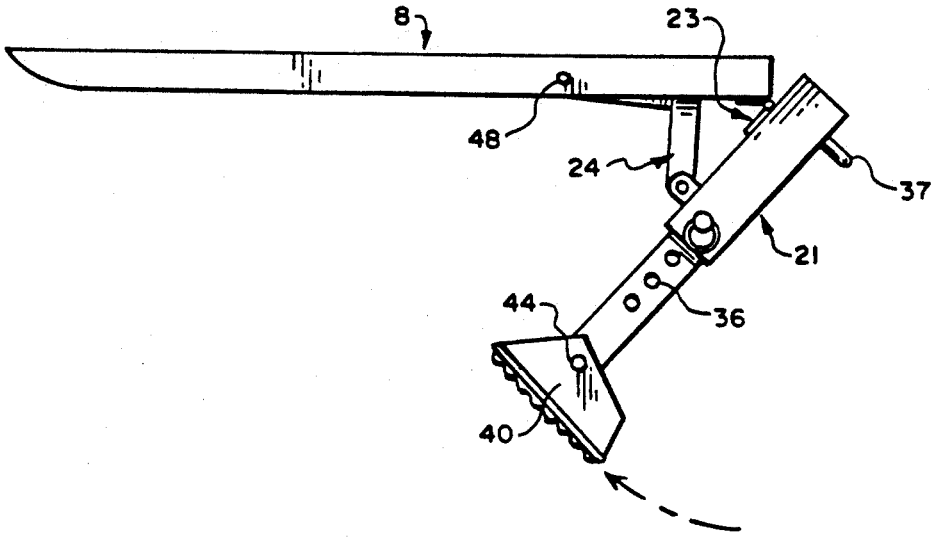
FIG. 5 is an enlarged side view of my knockdown roof platform showing the manner in which the platform can be collapsed for storage by moving the legs in the direction indicated by the arrow.
Figure 6:
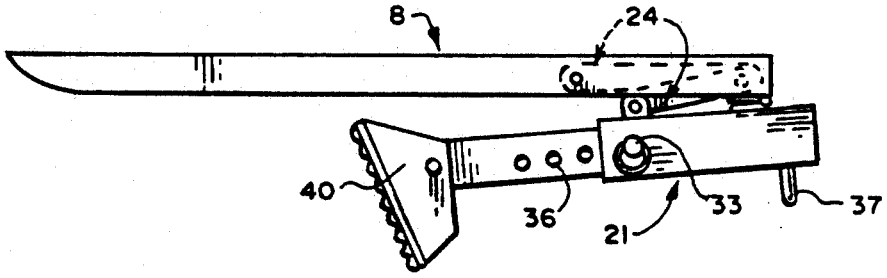
FIG. 6 is a side view of my knockdown roof platform when in a collapsed portable position for storage.

To facilitate in the handling of the platform, I have provided a unique mounting arrangement for the collapsible leg locking brackets 24,24 between the table structure 15 and the aluminum leg structure 21. To this end, the collapsible leg locking brackets 24,24 are each identical to one another and include a pair of bracket legs 46,46. The bracket legs are pivotally connected together by a pin 47 as shown in FIG. 4. The opposite ends of the legs 46,46 are connected by other attachment pins 48 and 49 respectively to the table structure 15 at one end and to the U-shaped hollow upper leg structure 25 at an opposite end. It will be further appreciated as shown in FIG. 5 and 6, that the leg locking brackets 24 are collapsible whereby the legs 46,46 move on their pivots at opposite ends 47, 48 and 49 so that the aluminum leg structure 21 and the table structure 15 can move together with the collapsing of the hinge 23 to approach a parallel relationship with respect to one another as shown in FIG. 6.

As a possible alternative construction, it is contemplated that the leg structure 21 can be manufactured from a suitable molded synthetic plastic material. This alternative platform could also be made with the table structure 15 being manufactured from a different material such as aluminum or the like. Thus, it is envisioned that the platform could be comprised of a plurality of different materials all for the purpose of reducing cost and providing a platform structure having the desired strength characteristics to be adequate for the purposes intended.

While I have illustrated and described a single specific embodiment of my invention, it will be understood, that this is by way of illustration only and that various changes and modifications may be contemplated within the scope of the following claims.

I claim:

1. A knockdown roof platform of a generally L-shape when viewed at either side for use on an inclined roof comprising a table structure having an upper flat table top, the table structure having a hollowed area on its underside, struts formed integral inside said hollowed area on an underside of said upper flat table top, an upright leg structure having two legs, said upright leg structure being positioned only at one end of said table structure having an upper flat table surface positioned in a common plane with said upper flat table top when said leg structure is in an upright position, hinge means connecting said table structure and said upright leg structure in assembly together, hinge means positioned beneath the table structure on an inner side of said leg structure beneath an upper most surface of the leg structure, the upper most surface of the leg structure being co-planar with said upper flat table top when said leg structure is positioned in right angular relation to the flat table top, collapsible locking bracket means further securing said table structure and said upright leg structure in assembly, said collapsible locking bracket means being adjustable to secure said table structure and said upright leg structure in right angular relation when in the upright position and thereby positioning said upper flat table top co-planar with said upper flat table top on said table structure, said collapsible locking bracket being releasable enabling said table structure and said upright leg structure to be pivoted on said hinge means thus moving and collapsing said table structure and said upright leg structure out of right angular relation relative to one another and into a storage position where the table structure and said upright leg structure extend almost in parallel relation.

2. The knockdown roof platform of claim 1 wherein said upright leg structure is essentially U-shaped, opposite legs of said U-shaped comprising a pair of spaced apart hollow open ended parallel-sided tubular supports, parallel-sided adjustably positionable tubular legs insertable into said spaced apart hollow open ended parallel-sided tubular supports, attached means joining said tubular supports with said tubular legs in telescoped adjusted assembly, said attachment means comprising alignable holes, said tubular legs and supports, said attachment means further comprising removable and attachable pin insertable in said holes joining said adjustably positionable legs in a selected assembled position with said opposite legs thereby fixing said upper flat table top in a roof supported horizontal plane.

3. The knockdown roof platform of claim 2 wherein said opposite legs have rubber feet mounted on lower ends of said legs, said feet having a gripping surface capable of being slippage resistant, feet pivot means securing said rubber feet with lower ends of said adjustably positionable legs in assembly together enabling said feet to be positioned in one of a series of preselected positions to enable the rubber feet to assume a posture corresponding to an inclination of an inclined roof for supported engagement on the inclined roof.

4. A knockdown roof platform for use on an inclined roof comprising a table structure having an upper flat table top comprised on a lightweight metal, the table structure having a hollowed area on its underside, struts formed integral inside said hollowed area on an underside of said upper flat table top, an upright leg structure having two legs, said upright leg structure being positioned only at one end of said table structure having ann upper flat table surface positioned in a common plane with said upper flat table top, when said leg structure is in an upright position, hinge means located beneath said flat table top connecting said table structure and said upright leg structure in assembly together, said hinge means including a pair of hinge plates attached to an under side of said flat table top and to an inside surface area of said upright leg structure, collapsible locking bracket means further securing said table structure and said upright leg structure in assembly, said collapsible locking bracket means being adjustable to secure said table structure and said upright leg structure in right angular relation and thereby positioning said upper flat table top co-planar with said upper flat table top on said table structure, said collapsible locking bracket being releasable enabling said table structure and said upright leg structure to be pivoted on said hinge means including said hinge plates thus moving and collapsing said table structure and said upright leg structure and said hinge plates out of right angular relation relative to one another and into a storage position where the table structure and said upright leg structure extend almost in parallel relation.

5. A knockdown roof platform for use on an inclined roof comprising a table structure having an upper flat table top, the table structure having a hollowed area on its underside, struts formed integral inside said hollowed area on an underside of said upper flat table top thus providing an expanded table area for supporting articles, an upright leg structure positioned at one end of said table structure having an upper flat table surface positioned in a common plane with said upper flat table top, hinge means connecting said table structure and said upright leg structure in assembly together, collapsible locking bracket means further securing said table structure and said upright leg structure in assembly, said collapsible locking bracket means being adjustable to secure said table structure and said upright leg structure in right angular relation and thereby positioning said upper flat table top co-planar with said upper flat table top on said table structure, said collapsible locking bracket being releasable enabling said table structure and said upright leg structure to be pivoted on said hinge means thus moving and collapsing said table structure and said upright leg structure out of right angular relation relative to one another and into a storage position where the table structure and said upright leg structure extend almost in parallel relation, said upright leg structure is essentially U-shaped, opposite legs of said U-shape comprising a pair of spaced apart hollow open ended parallel-sided tubular supports, parallel-sided adjustably positionable tubular legs insertable into said spaced apart hollow open ended parallel-sided tubular supports, the parallel-sided tubular supports being sized to closely co-act with the parallel-sided tubular supports to prevent relative movement there between, attachment means joining said tubular supports with said tubular legs in telescoped adjusted assembly, said attachment means comprising alignable holes, said tubular legs and supports, said attachment means further comprising removable and attachable pin insertable in said holes joining said adjustably positionable legs in a selected assembled position with said opposite legs thereby fixing said upper flat table top in a roof supported horizontal plane.

6. The knockdown roof platform of claim 5 wherein said opposite legs have slippage resistant feet mounted on lower ends of said legs, feet pivot means securing said rubber feet with lower ends of said adjustably positionable legs in assembly together enabling said feet to be positioned in one of a series of preselected positions to enable the slippage resistant feet to assume a posture corresponding to an inclination of an inclined roof for supported engagement on the inclined roof.

7. The knockdown roof platform of claim 5 wherein the upright leg structure is mounted in hinged assembly with the upper flat table so that an upper surface of the upright leg structure is co-planar with the upper flat table surface of the table structure thus providing an enlarged work area when said upper flat table top and said upright leg structure are positioned in right angular relation relative to one another.

* * * * *